US009847079B2

(12) United States Patent
Clement et al.

(10) Patent No.: US 9,847,079 B2
(45) Date of Patent: Dec. 19, 2017

(54) METHODS AND APPARATUS TO USE PREDICTED ACTIONS IN VIRTUAL REALITY ENVIRONMENTS

(71) Applicant: Google Inc., Mountain View, CA (US)

(72) Inventors: Manuel Christian Clement, Felton, CA (US); Stefan Welker, Mountain View, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/151,169

(22) Filed: May 10, 2016

(65) Prior Publication Data

US 2017/0330545 A1 Nov. 16, 2017

(51) Int. Cl.

| | |
|---|---|
| ***G10H 3/00*** | (2006.01) |
| ***G10H 1/14*** | (2006.01) |
| ***G10H 7/00*** | (2006.01) |

(52) U.S. Cl.

CPC ..... *G10H 3/00* (2013.01); *G10H 1/14* (2013.01); *G10H 7/008* (2013.01); *G10H 2220/201* (2013.01); *G10H 2220/401* (2013.01); *G10H 2220/455* (2013.01)

(58) Field of Classification Search

CPC ..... G10H 3/00; G10H 1/14; G10H 7/008; G10H 2220/201; G10H 2220/401; G10H 2220/455

USPC ..... 84/615

See application file for complete search history.

(56) References Cited

U.S. PATENT DOCUMENTS

| | | | | | |
|---|---|---|---|---|---|
| 4,980,519 | A | * | 12/1990 | Mathews | G06F 3/044 178/19.01 |
| 5,513,129 | A | * | 4/1996 | Bolas | G06F 3/011 703/13 |
| 5,835,077 | A | * | 11/1998 | Dao | G01C 9/00 345/157 |
| 6,066,794 | A | * | 5/2000 | Longo | G10H 1/02 84/600 |
| 6,148,280 | A | * | 11/2000 | Kramer | A63B 69/3608 340/524 |

(Continued)

FOREIGN PATENT DOCUMENTS

| | | |
|---|---|---|
| EP | 2286932 A2 | 2/2011 |
| EP | 2945045 A1 | 11/2015 |

OTHER PUBLICATIONS

"Virtual Drums: A 3D Drum Set", retrieved on Nov. 24, 2015 from http://www.virtualdrums, 2 pages.

(Continued)

*Primary Examiner* — David Warren
*Assistant Examiner* — Christina Schreiber
(74) *Attorney, Agent, or Firm* — Brake Hughes Bellermann LLP

(57) ABSTRACT

Methods and apparatus to use predicted actions in VR environments are disclosed. An example method includes predicting a predicted time of a predicted virtual contact of a virtual reality controller with a virtual musical instrument, determining, based on at least one parameter of the predicted virtual contact, a characteristic of a virtual sound the musical instrument would make in response to the virtual contact, and initiating producing the sound before the predicted time of the virtual contact of the controller with the musical instrument.

20 Claims, 13 Drawing Sheets

(56) References Cited

U.S. PATENT DOCUMENTS 6,150,600 A * 11/2000 Buchla ..... G10H 1/0555 84/688
6,256,044 B1 * 7/2001 Carraro ..... G06T 15/20 345/419
6,388,183 B1 * 5/2002 Leh ..... G10H 1/0008 84/645
7,939,742 B2 * 5/2011 Glaser ..... G10H 1/0555 84/600
7,973,232 B2 * 7/2011 Lengeling ..... G10H 1/20 84/718
8,164,567 B1 * 4/2012 Barney ..... A63F 13/245 345/158
8,586,853 B2 * 11/2013 Sakazaki ..... G10H 1/053 84/725
8,759,659 B2 * 6/2014 Tabata ..... G10H 1/0008 84/615
8,830,162 B2 * 9/2014 Helmer ..... G10H 1/342 345/156
8,858,330 B2 * 10/2014 Raymond ..... A63F 13/24 463/35
9,154,870 B2 * 10/2015 Watanabe ..... H04R 3/12
9,171,531 B2 * 10/2015 David ..... G10H 1/40
9,480,929 B2 * 11/2016 Weston ..... A63H 3/36
9,542,919 B1 * 1/2017 Bencar ..... G10H 1/0025
9,666,173 B2 * 5/2017 Lee ..... G10H 1/34
2002/0021287 A1 * 2/2002 Tomasi ..... G06F 1/1613 345/168
2002/0102024 A1 * 8/2002 Jones ..... G06K 9/00248 382/225
2003/0058339 A1 * 3/2003 Trajkovic ..... G06K 9/00335 348/155
2003/0100965 A1 * 5/2003 Sitrick ..... G09B 15/023 700/83
2006/0098827 A1 * 5/2006 Paddock ..... G10L 21/02 381/106
2007/0256551 A1 * 11/2007 Knapp ..... G09B 5/065 84/722
2009/0114079 A1 * 5/2009 Egan ..... G09B 15/023 84/477 R
2010/0138680 A1 * 6/2010 Brisebois ..... G06F 1/1626 713/324
2010/0150359 A1 * 6/2010 KnicKrehm ..... G01H 7/00 381/58
2010/0322472 A1 * 12/2010 Hamalainen ..... G06K 9/6203 382/103
2011/0227919 A1 * 9/2011 Bongio ..... G06T 19/20 345/426
2011/0300522 A1 * 12/2011 Faubert ..... A61B 5/16 434/236
2011/0316793 A1 * 12/2011 Fushiki ..... G06F 3/04886 345/173
2012/0236031 A1 9/2012 Haddick et al.
2013/0044128 A1 * 2/2013 Liu ..... G09G 5/00 345/633
2013/0047823 A1 * 2/2013 Tabata ..... G10H 1/0008 84/639
2013/0222329 A1 * 8/2013 Larsby ..... G06F 3/04886 345/174
2014/0083279 A1 * 3/2014 Little ..... G10H 1/0008 84/609
2014/0204002 A1 7/2014 Bennet et al.
2015/0143976 A1 5/2015 Katto et al.
2015/0287395 A1 * 10/2015 Rapp ..... G10H 3/125 84/422.1
2015/0317910 A1 * 11/2015 Daniels ..... G09B 21/00 84/485 R
2015/0331659 A1 * 11/2015 Park ..... G10H 1/0083 700/94
2015/0358543 A1 * 12/2015 Kord ..... G06F 3/011 345/474
2016/0225188 A1 * 8/2016 Ruddell ..... G06T 19/006
2016/0364015 A1 * 12/2016 Send ..... G01S 17/32
2017/0003750 A1 * 1/2017 Li ..... G06F 3/017
2017/0003764 A1 * 1/2017 Li ..... G06F 3/0346
2017/0004648 A1 * 1/2017 Li ..... G02B 27/017
2017/0018121 A1 * 1/2017 Lawson ..... G06T 3/0093
2017/0038830 A1 * 2/2017 Clement ..... G06T 19/006
2017/0047056 A1 * 2/2017 Lee ..... G10H 1/0008

OTHER PUBLICATIONS

Berthaut, et al, "Piivert: Percussion-based Interaction for Immersive Virtual EnviRonmenTs", Symposium on 3D User Interfaces, Mar. 20-21, 2010, 5 pages.
Maeki-Patola, et al, "Experiments with Virtual Reality Instruments", Proceedings of the 2005 International Conference on New Interfaces for Musical Expression (NIME05), May 26-28, 2005, 6 pages.
"Aerodrums Intros Virtual Reality Drum Set for Oculus Rift", 2016 NAMM Show, http://www.synthtopia.com/content/2016/01/22/aerodrums-intros-virtual-reality-drum-set-for-oculus-rift/, Jan. 22, 2016, 2 pages.
Hutchings, "Interact With a Screen Using Your Hand, Paintbrush or Drumstick", http://www.psfk.com/2015/08/pressuresensitiveinputdevicesenselmorph.html#run, Aug. 26, 2015, 5 pages.
International Search Report and Written Opinion for PCT Application No. PCT/US2016/068544, dated Apr. 12, 2017, 10 pages.
International Search Report and Written Opinion for PCT Application No. PCT/US2017/031887, dated Jun. 29, 2017, 14 pages.

* cited by examiner

METHODS AND APPARATUS TO USE PREDICTED ACTIONS IN VIRTUAL REALITY ENVIRONMENTS

RELATED APPLICATION(S)

U.S. Provisional Patent Application No. 62/334,034, filed on May 10, 2016, entitled "VOLUMETRIC VIRTUAL REALTY KEYBOARD METHODS, USER INTERFACE, AND INTERACTIONS" is incorporated herein by reference in its entirety.

FIELD OF THE DISCLOSURE

This disclosure relates generally to virtual reality (VR) environments, and, more particularly, to methods and apparatus to use predicted actions in VR environments.

BACKGROUND

VR environments provide users with applications with which they can interact with virtual objects. Some conventional VR musical instruments have sound variations based on how the instruments are contacted. For example, how fast, how hard, where, etc.

SUMMARY

Methods and apparatus to use predicted actions in VR environments are disclosed. An example method includes predicting a predicted time of a predicted virtual contact of a virtual reality controller with a virtual musical instrument, determining, based on at least one parameter of the predicted virtual contact, a characteristic of a virtual sound the musical instrument would make in response to the virtual contact, and initiating producing the sound before the predicted time of the virtual contact of the controller with the musical instrument.

An example apparatus includes a processor, and a non-transitory machine-readable storage media storing instruments that, when executed, causes the processor predict a predicted time of a predicted virtual contact of a virtual reality controller with a virtual musical instrument, determine, based on at least one parameter of the predicted virtual contact, a characteristic of a virtual sound the musical instrument would make in response to the virtual contact, and initiate producing the sound before the predicted time of the virtual contact of the controller with the musical instrument occurs.

An example non-transitory machine-readable media storing machine-readable instructions that, when executed, cause a machine to at least predict a predicted time of a predicted virtual contact of a virtual reality controller with a virtual musical instrument, determine, based on at least one parameter of the predicted virtual contact, a characteristic of a virtual sound the musical instrument would make in response to the virtual contact, and initiate producing of the sound before the predicted time of the virtual contact of the controller with the musical instrument occurs.

DETAILED DESCRIPTION

Figure 1:
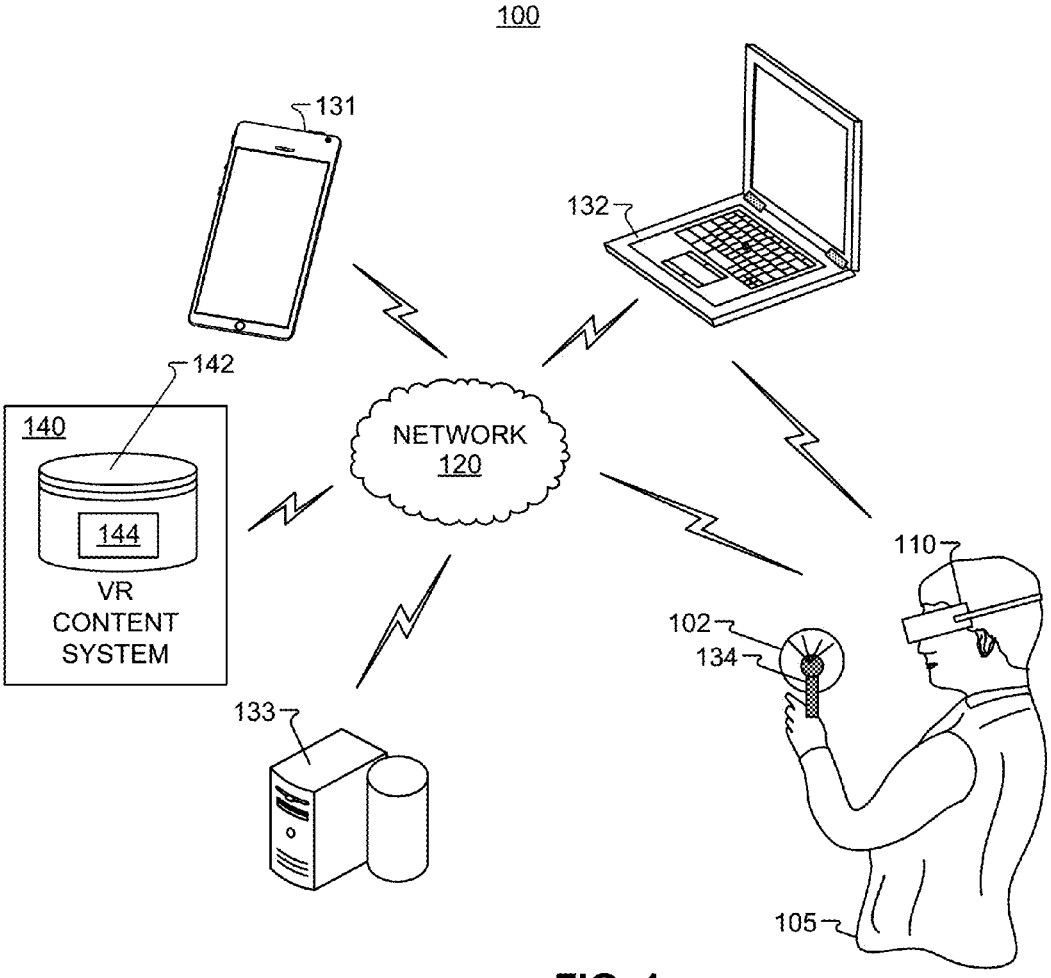
FIG. 1 is a block diagram of an example system for creating and interacting with a three-dimensional (3D) VR environment in accordance with this disclosure.

Reference will now be made in detail to non-limiting examples of this disclosure, examples of which are illustrated in the accompanying drawings. The examples are described below by referring to the drawings, wherein like reference numerals refer to like elements. When like reference numerals are shown, corresponding description(s) are not repeated and the interested reader is referred to the previously discussed figure(s) for a description of the like element(s).

Turning to FIG. 1, a block diagram of an example virtual reality (VR) system 100 for creating and interacting with a three-dimensional (3D) VR environment in accordance with the teachings of this disclosure is shown. In general, the system 100 provides the 3D VR environment and VR content for a user to access, view, and interact with using the examples described herein. The system 100 can provide the user with options for accessing the content, applications, virtual objects (e.g., a drum 102, a door knob, a table, etc.), and VR controls using, for example, eye gaze and/or movements within the VR environment. The example VR system 100 of FIG. 1 includes a user 105 wearing a head-mounted display (HMD) 110. The virtual contacts, interactions, sounds, instruments, objects, etc. that are described herein are virtual and will be displayed, rendered and/or produced in an HMD, such as the HMD 110. For example, an HMD or a device communicatively coupled to the HMD can predict a predicted time of a virtual contact of a virtual reality controller with a virtual musical instrument, determine, based on at least one parameter of the predicted virtual contact, a characteristic of a virtual sound the musical instrument would make in response to the virtual contact, and initiate producing the sound before the predicted time of the virtual contact of the controller with the musical instrument. In this way, the output of virtual musical instruments can be as seem more natural, e.g., more as they are in non-virtual environments. For example, sounds produced by virtual musical instruments occur closer to their associated virtual contact(s).

As shown in FIG. 1, the example VR system 100 includes a plurality of computing and/or electronic devices that can exchange data over a network 120. The devices may represent clients or servers, and can communicate via the network 120 or any other additional and/or alternative network(s). Example client devices include, but are not limited to, a mobile device 131 (e.g., a smartphone, a personal digital assistant, a portable media player, etc.), an electronic tablet, a laptop or netbook 132, a camera, the HMD 110, a desktop computer 133, a VR controller 134, a gaming device, and any other electronic or computing devices that can communicate using the network 120 or other network(s) with other computing or electronic devices or systems, or that may be used to access VR content or operate within a VR environment. The devices 110 and 131-134 may represent client or server devices. The devices 110 and 131-134 can execute a client operating system and one or more client applications that can access, render, provide, or display VR content on a display device included in or in conjunction with each respective device 110 and 131-134.

The VR system 100 may include any number of VR content systems 140 storing content and/or VR software modules 142 (e.g., in the form of VR applications 144) that can generate, modify, and/or execute VR scenes. In some examples, the devices 110 and 131-134 and the VR content system 140 include one or more processors and one or more memory devices, which can execute a client operating system and one or more client applications. The HMD 110, the other devices 131-133 or the VR content system 140 may be implemented by the example computing devices P00 and P50 of FIG. 15.

The VR applications 144 can be configured to execute on any or all of devices 110 and 131-134. The HMD device 110 can be connected to devices 131-134 to access VR content on VR content system 140, for example. Device 131-134 can be connected (wired or wirelessly) to HMD device 110, which can provide VR content for display. A user's VR system can be HMD device 110 alone, or a combination of device 131-134 and HMD device 110.

Figure 2:
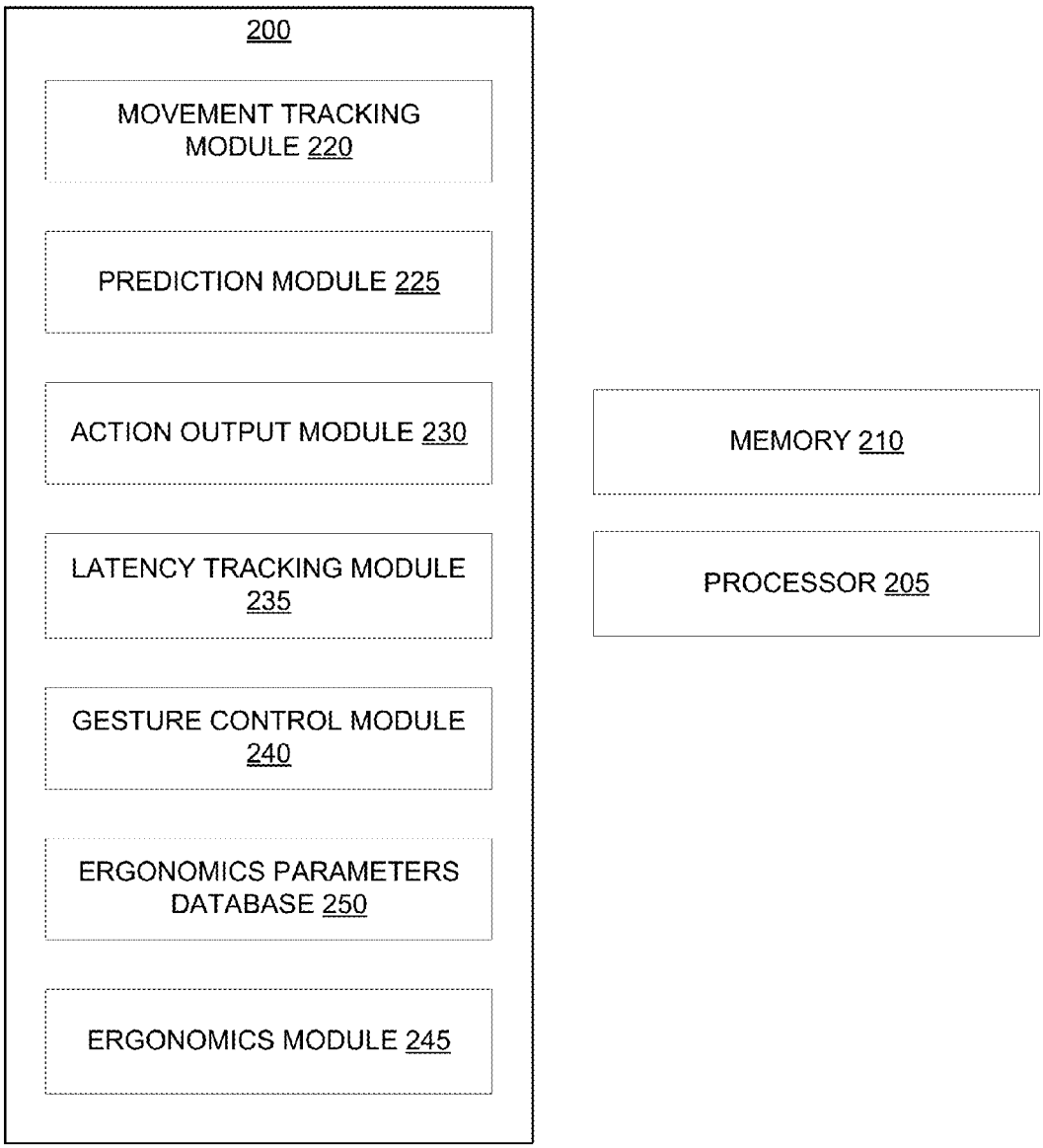
FIG. 2 is a diagram that illustrates an example VR application that may be used in the example VR environment of FIG. 1.

FIG. 2 is a schematic diagram of an example VR application 200 that may be used to implement the example VR applications 144 of FIG. 1. When executed, the VR application 200 can generate, modify, or execute VR scenes. Example VR applications 200 include, but are not limited to, virtual musical instruments, document editing, household, etc. applications. The HMD 110 and the other devices 131-133 can execute the VR application 200 using a processor 205 and associated memory 210 storing machine-readable instructions, such as those shown and described with reference to FIG. 15. In some implementations, the processor 205 can be, or can include, multiple processors and the memory 210 can be, or can include, multiple memories.

To determine (e.g., detect, track, measure, image, etc.) motion and position of a controller in a VR environment (e.g., the VR system 100 of FIG. 1), the example VR application 200 includes a movement tracking module 220. In a non-limiting example, a user (not shown) can access VR content in a 3D virtual environment using the mobile device 131 connected to the HMD device 110. While in the VR environment, the user can move around and look around. The movement tracking module 220 can track user movement and position. User movement may indicate how the user is moving his or her body (or device representing a body part such as a controller) within the VR environment. The example movement tracking module 220 of FIG. 2 can include a six degrees of freedom (6DOF) controller. The 6DOF controller can track and record movements that can be used to determine where a virtual object is contacted, how hard an object is contacted, etc. One or more cameras may, additionally or alternatively, be used track position and movement. In some examples, contact is between a VR controller and a VR object, such as a VR musical instrument. Example instruments include, but are not limited to, a drum or other percussion instruments, a piano, a stringed instrument, a trombone, etc.

To predict (e.g., anticipate, expect, etc.) movement, the example VR application 200 of FIG. 2 includes a prediction module 225. The example prediction module 225 of FIG. 2 uses any number and/or type(s) of methods, algorithms, etc. to predict future movement, velocity, force, momentum, area of contact, location of contact, direction of contact, position, etc. For example, a current position, current direction and current velocity can be used to predict a future position. For example, a future position can be predicted as:

$$\text{future_position}=\text{current_position}+\text{direction}*\text{velocity}*\text{time}$$

In some examples, position tracking may factor in other parameter such as past prediction errors (e.g., contacted object at a different point than predicted, missed object, contacted at a different velocity than predicted, etc.). For example, past prediction errors and past trajectory information can be gathered as errors, uploaded to a server in the cloud, and used to adapt or learn an improved prediction model.

To determine the output of an object caused by contact with the object, the example VR application 200 includes an action output module 230. The action output module 230 determines and then renders for the user the object output. Example object outputs include sound, light, color of light, object movement, etc.

In some examples, the movement tracking module 220 determines when contact with an object has occurred; and the action output module 230 determines the object output in response to the determined contact, and initiates rendering of the object output, e.g., producing a sound.

In some other examples, the prediction module 225 predicts when contact with an object is expected to occur; and the action output module 230 determines the object output in response to the predicted contact, and initiates rendering of the object output, e.g., producing a sound.

In still further examples, the prediction module 225 determines when to initiate the rendering of the object output, e.g., producing of sound, to reduce latency between a time of actual virtual contact and a user's perception of a time of virtual contact of the object output. For example, the action output module 230 may be triggered by the prediction module 225 to initiate rendering of the object output at a time preceding anticipated contact so that any latency (e.g., processing latency, rendering latency, etc.) still allows the object output to start at, for example, approximate a time of actual contact (or intended contact time).

To determine latencies, the example VR application 200 of FIG. 2 includes a latency tracking module 235. The example latency tracking module 235 tracks the time from when an object output is initiated and when the object output is started to be rendered. Example algorithms and/or methods that may be used to track latency include an average, a windowed average, a moving average, an exponential average, etc. Factors such as system processing load, system processing time, queuing, transmission delay, etc. may impact latency.

To detect gestures, the example VR application 200 of FIG. 2 includes a gesture control module 240. The example gesture control module 240 uses tracked and/or recorded movements provided by the movement tracking module 220. Any number and/or type(s) of method(s) and algorithm(s) may be used to detect the gestures disclosed herein. Example gestures include, but are not limited to, a throw, a toss, a flip, a flick, a grasp, a pull, a strike, a slide, a stroke, a position adjustment, a push, a kick, a swipe, etc. The gestures may be carried out using one or more of a limb, a head, a body, a finger, a hand, a foot, etc. The gestures can be qualified by comparing one or more parameters of the gesture, for example, a range of movement, a velocity of movement, acceleration of movement, distance of movement, direction of movement, etc.

In some examples, objects can be positioned in one VR application (e.g., a musical instrument application) and their position can be used in that VR application or another VR application to automatically position VR objects. For examples, the adjusted position of an object (e.g., a drum, a sink height, etc.) can be used to automatically position, for example, a door knob height, a table height, a counter height, etc. In such examples, a person with, for example, a disability can set an object height across multiple VR application with a single height adjustment. To share ergonomic information, the example VR application 200 of FIG. 2 includes an ergonomic module 245 and an ergonomics parameters database 250. The ergonomic module 245 uses the position of VR objects to automatically or to assist in the ergonomic placement of other objects.

In some examples, the ergonomic module 245 can place, or assist in the placement of, objects in a location based on user action. In some examples, the ergonomic module 245 can modify a location of an object based on user action. For example, if a user's strikes of a drum routinely fall short of the drum, the ergonomic module 245 can automatically adjust the height of the drop so future strikes contact the drum.

Figure 3:
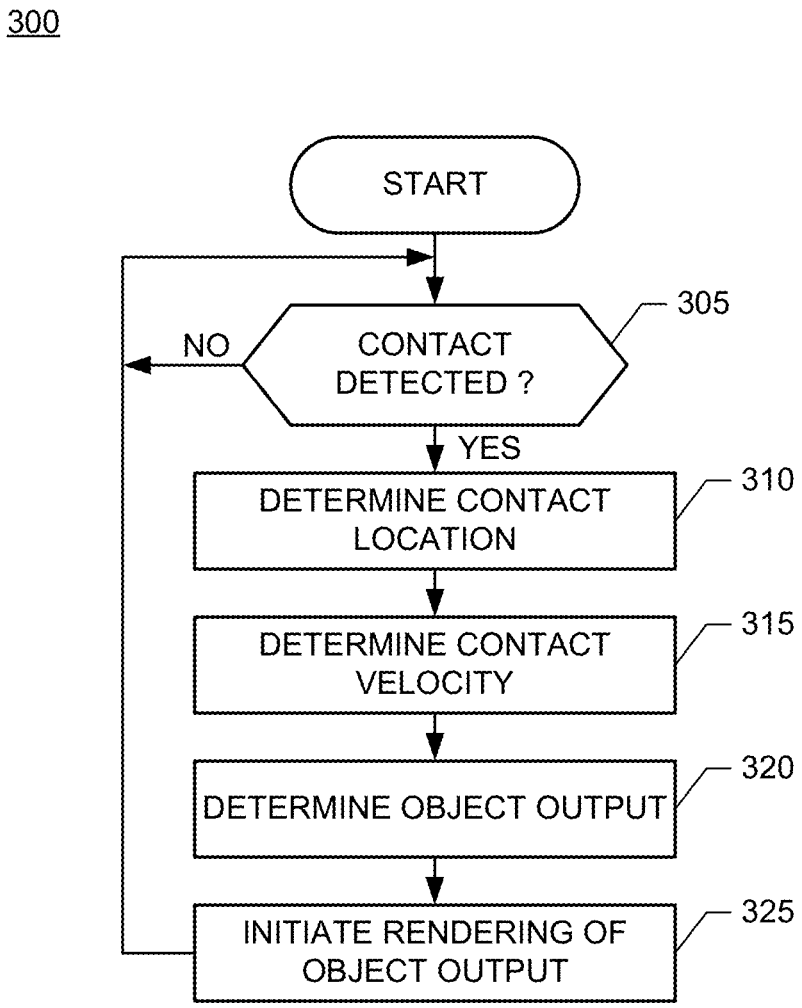
FIG. 3 is a flowchart representing an example method that may be used to adapt a VR object output based on a velocity.
Figure 4A:
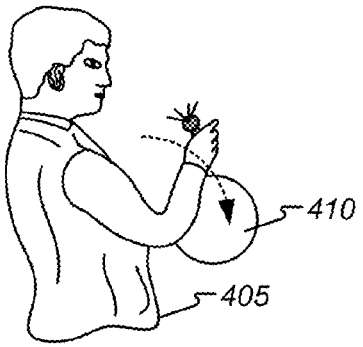
FIGS. 4A and 4B sequentially illustrate an example striking of a drum.
Figure 5A:
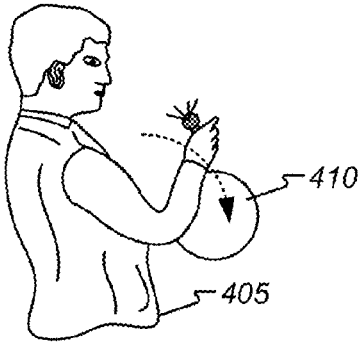
FIGS. 5A, 5B and 5C sequentially illustrate another example striking of a drum.
Figure 4B:
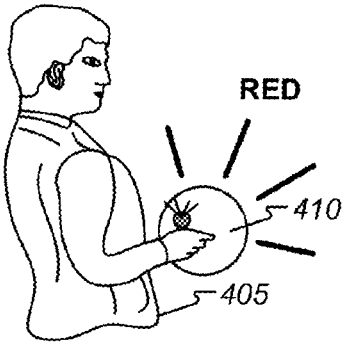
Figure 5B:
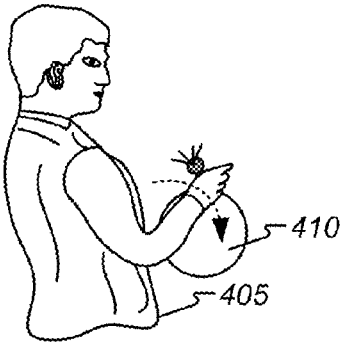
Figure 5C:
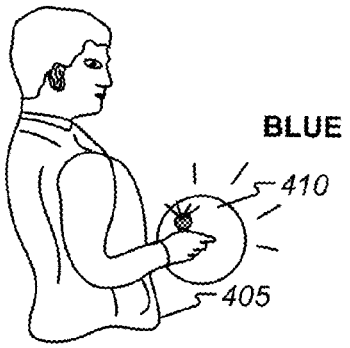
Figure 15:
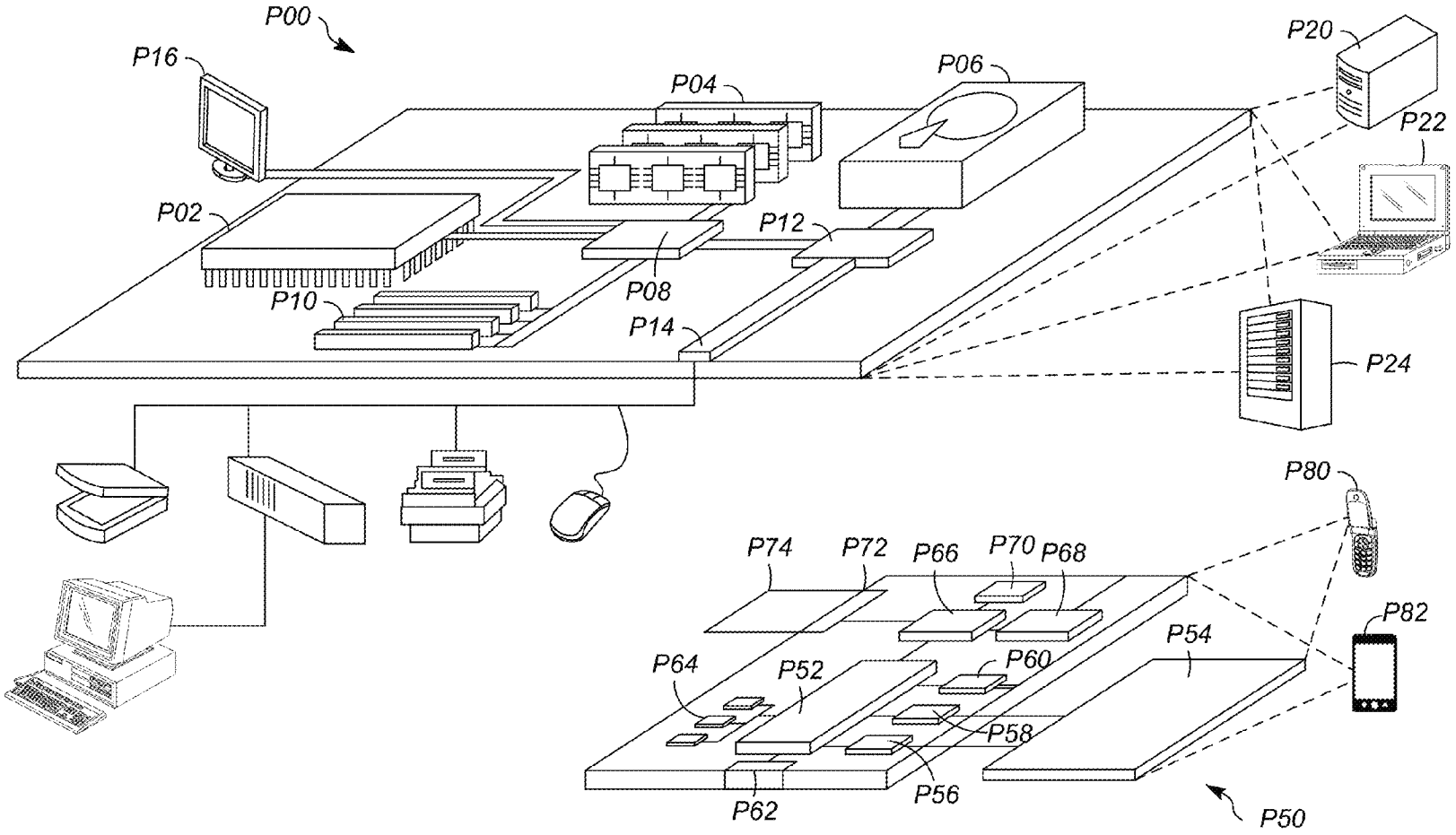
FIG. 15 is a block diagram of an example computer device and an example mobile computer device, which may be used to implement the examples disclosed herein.

FIG. 3 is a flowchart of an example process 300 that may, for example, be implemented as machine-readable instructions carried out by one or more processors, such as the example processors of FIG. 15, to implement the example VR applications and systems disclosed herein. The example process 300 of FIG. 3 begins with the example movement tracking module 220 detecting contact (e.g., a representation of contact, virtual contact) with an object (block 305 and line 605 FIG. 6) (e.g., see FIGS. 4A and 4B), determining contact location (block 310), and determining contact velocity (block 315). The action output module 230 determines the object output resulting from the contact location and velocity (block 320). For example, in FIGS. 4A-B, the user 405 strikes a drum 410 at a greater velocity than in FIGS. 5A-C. Thus, in these examples, the output associated with the drum 410 in FIG. 4B is louder than the drum 410 in FIG. 5C. The action output module 230 initiates rendering of the object output (block 325) and control returns to block 305 to wait for another contact (block 305). Other example characteristics of the object output that may also vary based on contact include a rendered color, a rendered color saturation, an acoustic shape of the sound, etc.

Figure 14A:
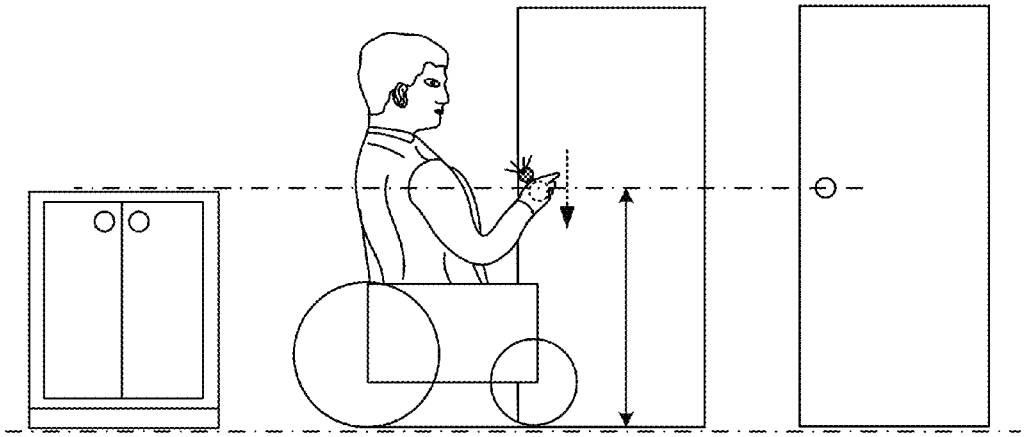
FIGS. 14A and 14B sequentially illustrate another example ergonomic adjustment.
Figure 14B:
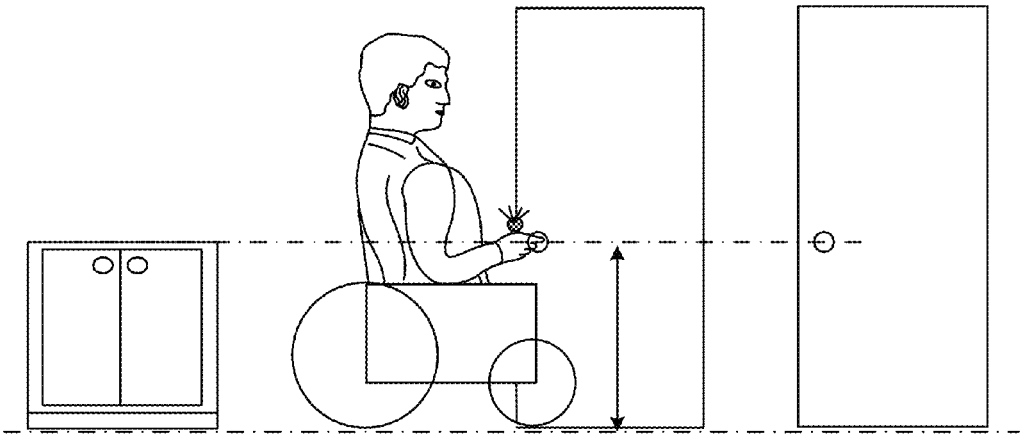

FIGS. 4A-B, 5A-C and, similarly, FIGS. 14A-B are shown from the perspective of a 3$^{rd}$ person viewing a VR environment from within that VR environment. The person depicted in these figures is in this VR environment with the 3$^{rd}$ person, and is as seen by the 3$^{rd}$ person.

Figure 6:
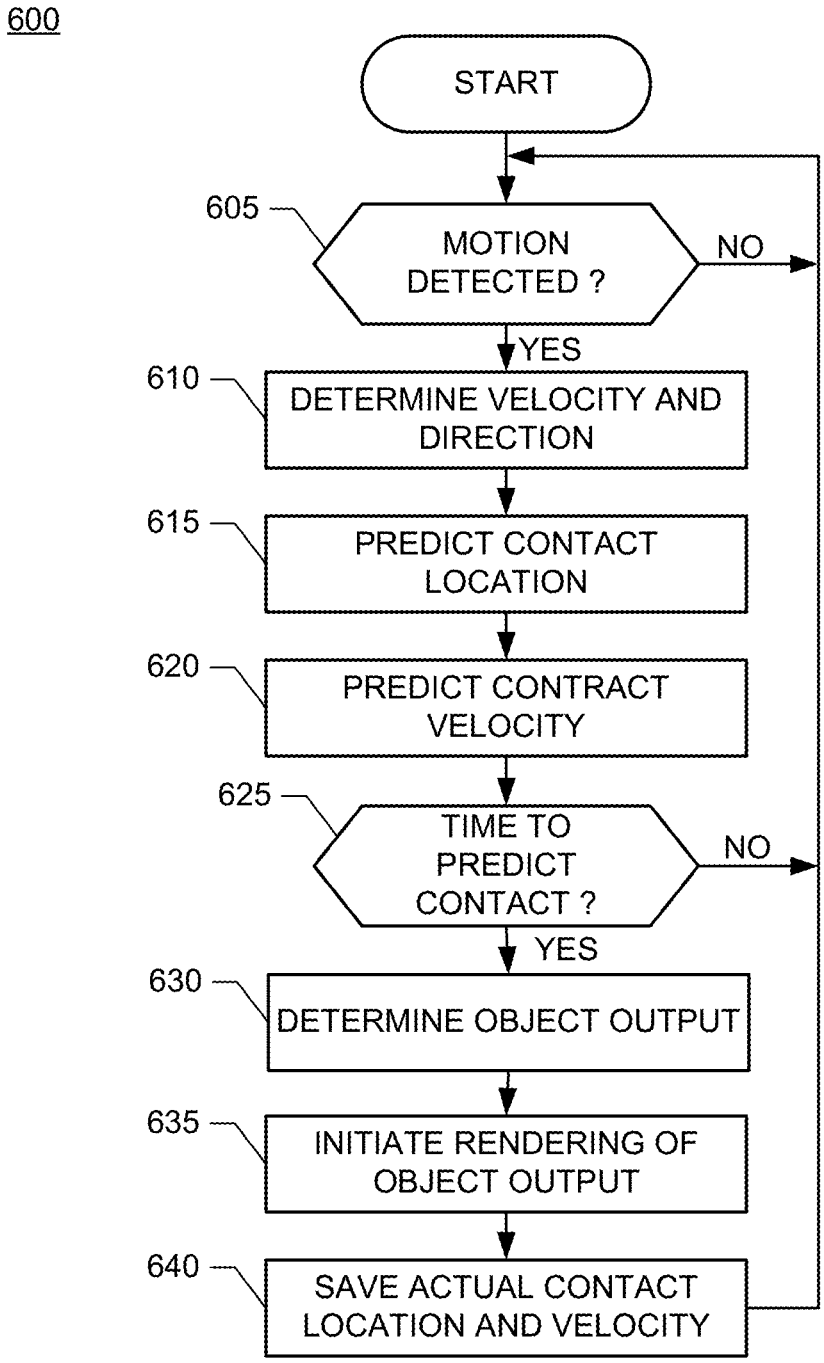
FIG. 6 is a flowchart representing an example method that may be used to predict contact with a VR object.

FIG. 6 is a flowchart of another example process 600 that may, for example, be implemented as machine-readable instructions carried out by one or more processors, such as the example processors of FIG. 15, to implement the example VR applications and systems disclosed herein. The example process 600 of FIG. 6 begins with the example movement tracking module 220 motion of, for example, a VR controller (block 605). The movement tracking module 220 determines the current location and current velocity (block 610). The prediction module 225 predicts a contact location (block 615) and contact velocity (block 620).

If a time to determine a predicted contact has occurred (block 625), the action output module 230 determines an object output for the contact (block 630) and initiates rendering (e.g., output) of the object output (block 635). The movement tracking module 220 retains the location and velocity of the contact when it occurs (block 640). Control then returns to block 605 to wait for additional movement.

Figure 7:
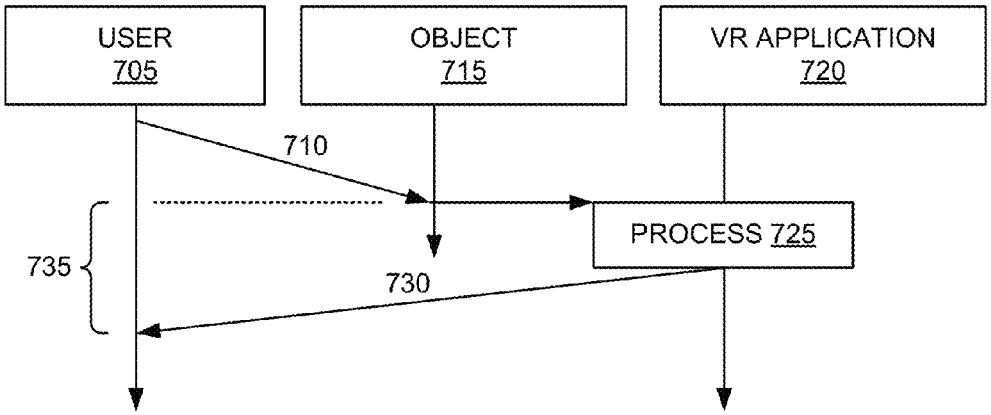
FIG. 7 is a diagram illustrating an example latency that may be realized by the example VR applications disclosed herein.
Figure 8:
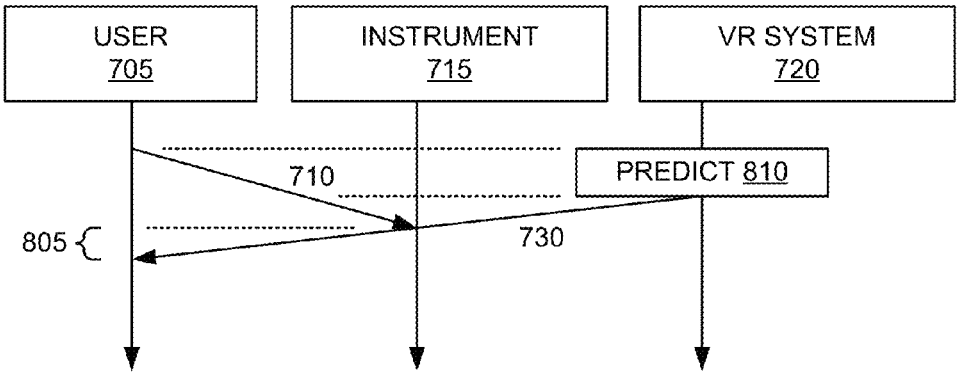
FIG. 8 is a diagram illustrating another example latency that may be realized by the example VR applications disclosed herein.

FIGS. 7 and 8 are diagrams showing different latencies associated with the example process 300 and the example process 600, respectively. In FIGS. 7 and 8, time moves downward. In FIG. 7, corresponding to FIG. 3, a user 705 moves (line 710) a controller into contact with an object 715. In response to the contact, a VR application 720 processes the contact to determine the appropriate object output (block 725) and initiates rendering of the object output, e.g., producing a sound, for the user (line 730). In FIG. 7, there is latency 735 between a time of the contact and start of the rendering of the object output (line 730).

In contrast to FIG. 7, FIG. 8 (corresponding to FIG. 6) shows a smaller latency 805 because the VR application 720 predicts (block 810) a predicted time when the contact will occur, and initiates rendering of the object output, e.g., producing a sound (line 730) before a time that the contact occurs. In this way, the sound can reach the user with shorter or no latency, thereby reducing distraction and increasing user satisfaction.

Because the predicting occurs over only a portion (e.g., 75%) of the movement 710, there is time between the end of that portion and the actual contact to pre-initiate output of the sound. By being able to initiate the output of the sound sooner than the actual contact, the user' perception of the sound can more naturally correspond to their expectation of how long after a virtual contact sound should be produced. While described herein with respect to virtual contacts and sounds, it should be understood that it may be used with other types of virtual objects. For example, if the switching of a switch is predicted, the turning on and off of lights can appear to more naturally arise from direct use of the switch.

Figure 9:
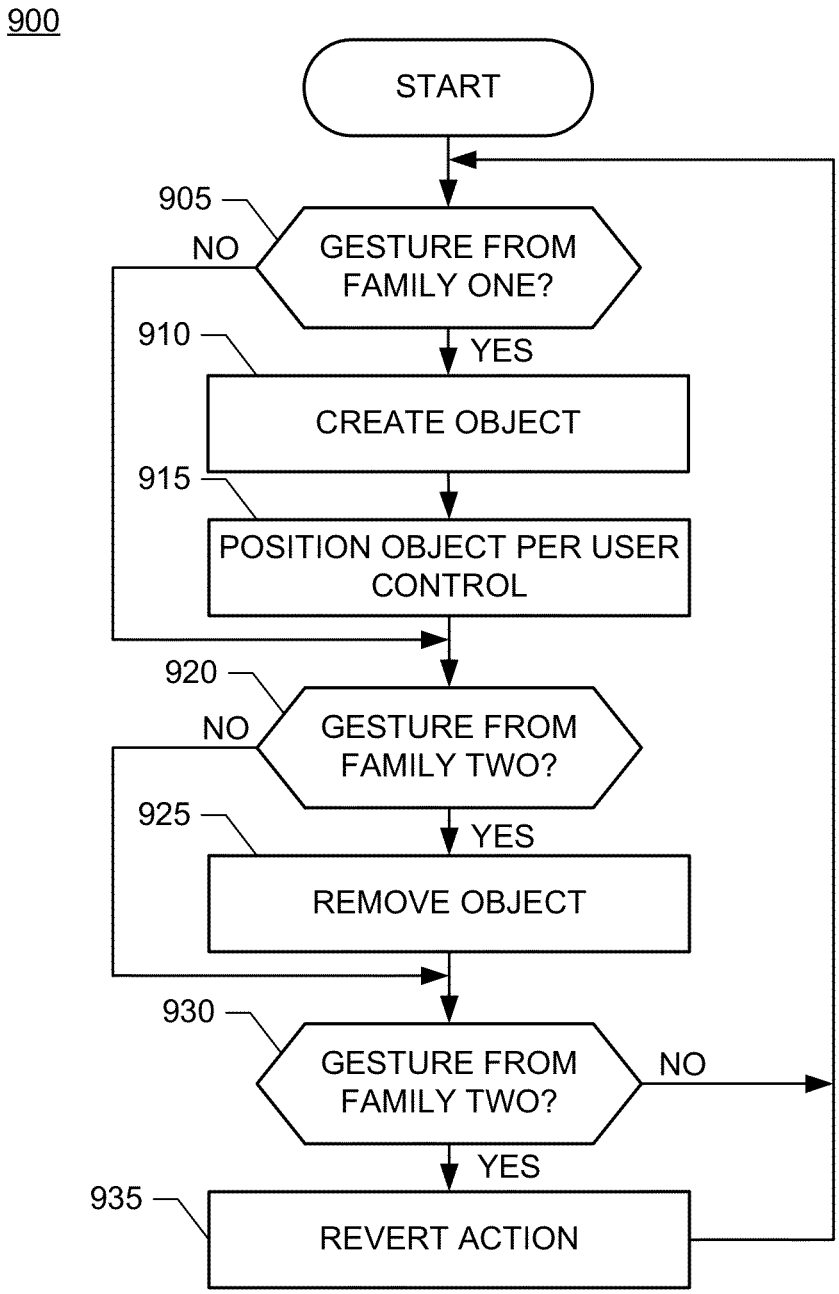
FIG. 9 is a flowchart representing an example method that may be used to control VR objects with gestures.

FIG. 9 is a flowchart of an example process 900 that may, for example, be implemented as machine-readable instructions carried out by one or more processors, such as the example processors of FIG. 15, to implement the example VR applications and systems disclosed herein. The example process 900 enables use of gestures of a controller to add objects, remove objects, position objects, revert (e.g., undo, start over, etc.) previous actions (e.g., edits to a document, etc.), etc. In the example of FIG. 9, gestures are classified generally into three categories: Category One—gestures to add and position objects, etc.; Category Two—gestures to remove objects, or place them out of view; and Category Three—gestures to undo previous actions.

The example process 900 of FIG. 9 begins with the gesture control module 240 determining if a gesture from Family One is detected (block 905). If a create-object gesture from Family One is detected (block 905), a new object is created (block 910). If a positioning object gesture from Family One is detected (block 905), the position of the object is changed per the gesture (block 915).

Figure 10A:
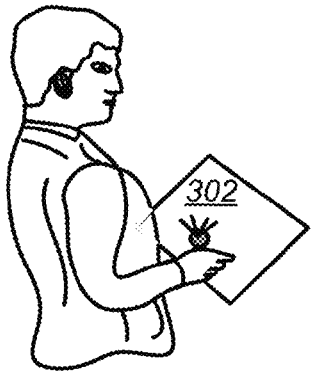
FIGS. 10A, 10B and 10C sequentially illustrate an example gesture to control VR objects.
Figure 10B:
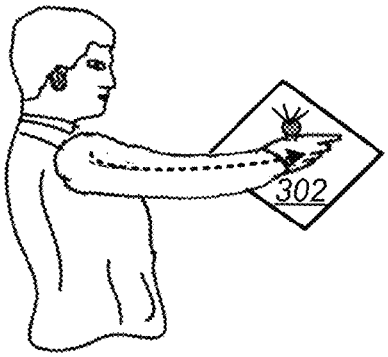
Figure 10C:
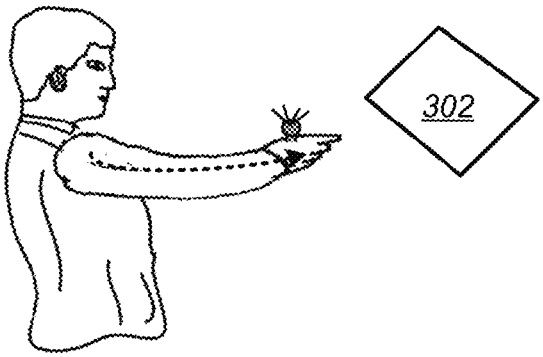

If a Family Two gesture is detected (block 920), the object is removed or moved out of sight (block 925). For example, see FIGS. 10A-C where an object 302 is moved out of sight using a tossing or flicking gesture.

Figure 11A:
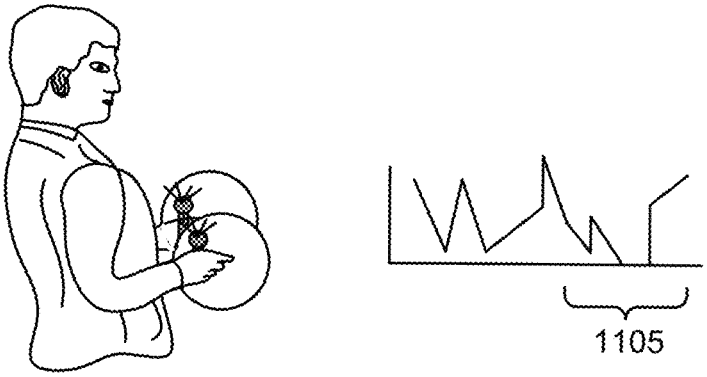
FIGS. 11A and 11B sequentially illustrate another example gesture to control VR objects.
Figure 11B:
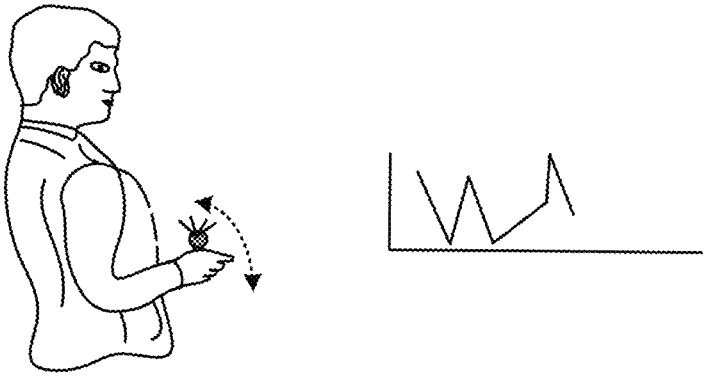

If a Family Three gesture is detected (block 930), a recent action is reverted (block 935) and control returns to block 905. Example actions that can be reverted are recent edits, create a blank object (e.g., file), remove all content in an object, etc. For example, see FIGS. 11A-B where a recent part of a sound track 1105 created using two drums is removed using a shaking back and forth gesture.

Figure 12:
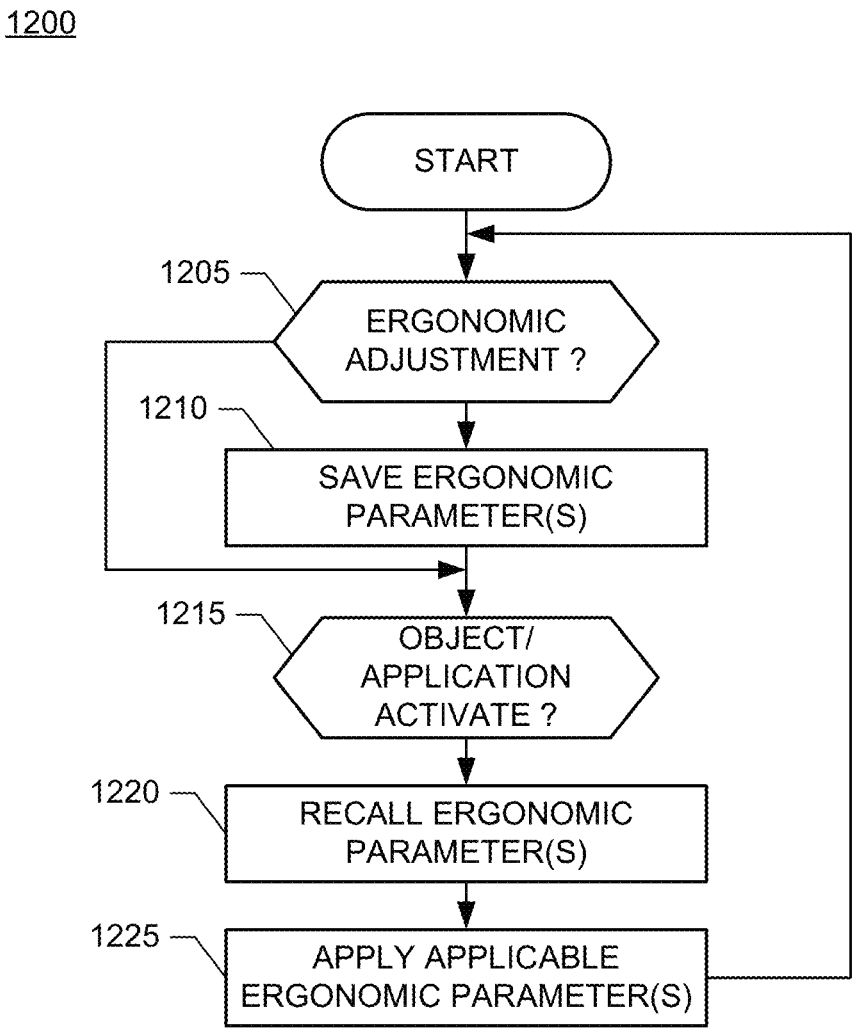
FIG. 12 is a flowchart representing an example method that may be used to apply ergonomic parameters.
Figure 13A:
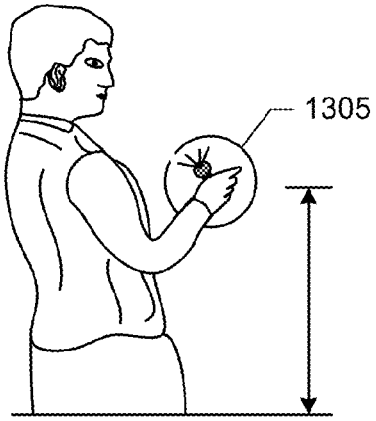
FIGS. 13A, 13B and 13C sequentially illustrate an example ergonomic adjustment.
Figure 13B:
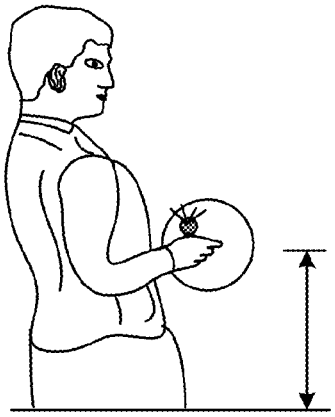

FIG. 12 is a flowchart of an example process 1200 that may, for example, be implemented as machine-readable instructions carried out by one or more processors, such as the example processors of FIG. 15, to implement the example VR applications and systems disclosed herein. The example process 1200 begins with the ergonomics module 245 determining whether an ergonomic adjustment (e.g., changing a position or height) of an object is being made (block 1205), for example, see adjusting height of a drum 1305 in FIGS. 13A-B and adjusting the height of a door knob 1405 in FIG. 14A. If an ergonomic adjusted is being made (block 1205), parameters representing the adjustments are saved in the database of parameters 250 (block 1210).

Figure 13C:
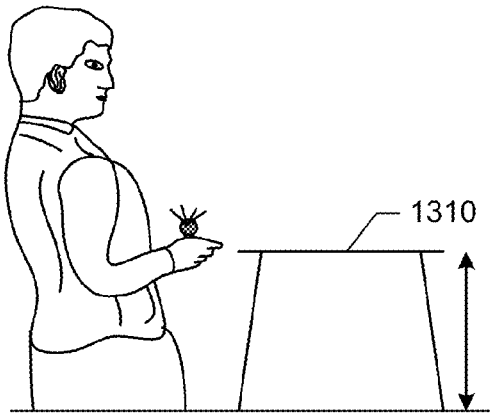

If an object and/or VR application is (re-)activated (block 1215), applicable ergonomic parameters are recalled from the database 250 of parameters (block 1220). For example, a preferred height of objects is recalled. The ergonomics module 245 automatically applies the recalled parameter(s) to the object and/or objects in the VR application (block 1225). For example, a table 1310 in FIG. 13C, and all knobs in FIG. 14B, a newly created drum, etc. Control then returns to block 1205. The changing of all knobs in response to the changing of one ergonomic parameter (e.g., height) is especially use to those needing environmental adaptations or assistive devices.

One or more of the elements and interfaces disclosed herein may be combined, divided, re-arranged, omitted, eliminated and/or implemented in any other way. Further, any of the disclosed elements and interfaces may be implemented by the example processor platforms P00 and P50 of FIG. 15, and/or one or more circuit(s), programmable processor(s), fuses, application-specific integrated circuit(s) (ASIC(s)), programmable logic device(s) (PLD(s)), field-programmable logic device(s) (FPLD(s)), and/or field-programmable gate array(s) (FPGA(s)), etc. Any of the elements and interfaces disclosed herein may, for example, be implemented as machine-readable instructions carried out by one or more processors. A processor, a controller and/or any other suitable processing device such as those shown in FIG. 15 may be used, configured and/or programmed to execute and/or carry out the examples disclosed herein. For example, any of these interfaces and elements may be embodied in program code and/or machine-readable instructions stored on a tangible and/or non-transitory computer-readable medium accessible by a processor, a computer and/or other machine having a processor, such as that discussed below in connection with FIG. 15. Machine-readable instructions comprise, for example, instructions that cause a processor, a computer and/or a machine having a processor to perform one or more particular processes. The order of execution of methods may be changed, and/or one or more of the blocks and/or interactions described may be changed, eliminated, sub-divided, or combined. Additionally, they may be carried out sequentially and/or carried out in parallel by, for example, separate processing threads, processors, devices, discrete logic, circuits, etc.

The example methods disclosed herein may, for example, be implemented as machine-readable instructions carried out by one or more processors. A processor, a controller and/or any other suitable processing device such as that shown in FIG. 15 may be used, configured and/or programmed to execute and/or carry out the example methods. For example, they may be embodied in program code and/or machine-readable instructions stored on a tangible and/or non-transitory computer-readable medium accessible by a processor, a computer and/or other machine having a processor, such as that discussed below in connection with FIG. 15. Machine-readable instructions comprise, for example, instructions that cause a processor, a computer and/or a machine having a processor to perform one or more particular processes. Many other methods of implementing the example methods may be employed. For example, the order of execution may be changed, and/or one or more of the blocks and/or interactions described may be changed, eliminated, sub-divided, or combined. Additionally, any or the entire example methods may be carried out sequentially and/or carried out in parallel by, for example, separate processing threads, processors, devices, discrete logic, circuits, etc.

As used herein, the term "computer-readable medium" is expressly defined to include any type of computer-readable medium and to expressly exclude propagating signals. Example computer-readable medium include, but are not limited to, one or any combination of a volatile and/or non-volatile memory, a volatile and/or non-volatile memory device, a compact disc (CD), a digital versatile disc (DVD), a read-only memory (ROM), a random-access memory (RAM), a programmable ROM (PROM), an electronically-programmable ROM (EPROM), an electronically-erasable PROM (EEPROM), an optical storage disk, an optical storage device, a magnetic storage disk, a magnetic storage device, a cache, and/or any other storage media in which information is stored for any duration (e.g., for extended time periods, permanently, brief instances, for temporarily buffering, and/or for caching of the information) and that can be accessed by a processor, a computer and/or other machine having a processor.

Returning to FIG. 1, the HMD device 110 may represent a VR headset, glasses, an eyepiece, or any other wearable device capable of displaying VR content. In operation, the HMD device 110 can execute a VR application 144 that can playback received, rendered and/or processed images for a user. In some instances, the VR application 144 can be hosted by one or more of the devices 131-134.

In some examples, the mobile device 131 can be placed, located or otherwise implemented in conjunction within the HMD device 110. The mobile device 131 can include a display device that can be used as the screen for the HMD device 110. The mobile device 131 can include hardware and/or software for executing the VR application 144.

In some implementations, one or more content servers (e.g., VR content system 140) and one or more computer-readable storage devices can communicate with the computing devices 110 and 131-134 using the network 120 to provide VR content to the devices 110 and 131-134.

In some implementations, the mobile device 131 can execute the VR application 144 and provide the content for the VR environment. In some implementations, the laptop computing device 132 can execute the VR application 144 and can provide content from one or more content servers (e.g., VR content server 140). The one or more content servers and one or more computer-readable storage devices can communicate with the mobile device 131 and/or laptop computing device 132 using the network 120 to provide content for display in HMD device 106.

In the event that HMD device 106 is wirelessly coupled to device 102 or device 104, the coupling may include use of any wireless communication protocol. A non-exhaustive list of wireless communication protocols that may be used individually or in combination includes, but is not limited to, the Institute of Electrical and Electronics Engineers (IEEE®) family of 802.x standards a.k.a. Wi-Fi® or wireless local area network (WLAN), Bluetooth®, Transmission Control Protocol/Internet Protocol (TCP/IP), a satellite data network, a cellular data network, a Wi-Fi hotspot, the Internet, and a wireless wide area network (WWAN).

In the event that the HMD device 106 is electrically coupled to device 102 or 104, a cable with an appropriate connector on either end for plugging into device 102 or 104 can be used. A non-exhaustive list of wired communication protocols that may be used individually or in combination includes, but is not limited to, IEEE 802.3x (Ethernet), a powerline network, the Internet, a coaxial cable data network, a fiber optic data network, a broadband or a dialup modem over a telephone network, a private communications network (e.g., a private local area network (LAN), a leased line, etc.).

A cable can include a Universal Serial Bus (USB) connector on both ends. The USB connectors can be the same USB type connector or the USB connectors can each be a different type of USB connector. The various types of USB connectors can include, but are not limited to, USB A-type connectors, USB B-type connectors, micro-USB A connectors, micro-USB B connectors, micro-USB AB connectors, USB five pin Mini-b connectors, USB four pin Mini-b connectors, USB 3.0 A-type connectors, USB 3.0 B-type connectors, USB 3.0 Micro B connectors, and USB C-type connectors. Similarly, the electrical coupling can include a cable with an appropriate connector on either end for plugging into the HMD device 106 and device 102 or device 104. For example, the cable can include a USB connector on both ends. The USB connectors can be the same USB type connector or the USB connectors can each be a different type of USB connector. Either end of a cable used to couple device 102 or 104 to HMD 106 may be fixedly connected to device 102 or 104 and/or HMD 106.

FIG. 15 shows an example of a generic computer device P00 and a generic mobile computer device P50, which may be used with the techniques described here. Computing device P00 is intended to represent various forms of digital computers, such as laptops, desktops, tablets, workstations, personal digital assistants, televisions, servers, blade servers, mainframes, and other appropriate computing devices. Computing device P50 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device P00 includes a processor P02, memory P04, a storage device P06, a high-speed interface P08 connecting to memory P04 and high-speed expansion ports P10, and a low speed interface P12 connecting to low speed bus P14 and storage device P06. The processor P02 can be a semiconductor-based processor. The memory P04 can be a semiconductor-based memory. Each of the components P02, P04, P06, P08, P10, and P12, are interconnected using various busses, and may be mounted on a common motherboard or in other manners as appropriate. The processor P02 can process instructions for execution within the computing device P00, including instructions stored in the memory P04 or on the storage device P06 to display graphical information for a GUI on an external input/output device, such as display P16 coupled to high speed interface P08. In other implementations, multiple processors and/or multiple buses may be used, as appropriate, along with multiple memories and types of memory. Also, multiple computing devices P00 may be connected, with each device providing portions of the necessary operations (e.g., as a server bank, a group of blade servers, or a multi-processor system).

The memory P04 stores information within the computing device P00. In one implementation, the memory P04 is a volatile memory unit or units. In another implementation, the memory P04 is a non-volatile memory unit or units. The memory P04 may also be another form of computer-readable medium, such as a magnetic or optical disk.

The storage device P06 is capable of providing mass storage for the computing device P00. In one implementation, the storage device P06 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory P04, the storage device P06, or memory on processor P02.

The high speed controller P08 manages bandwidth-intensive operations for the computing device P00, while the low speed controller P12 manages lower bandwidth-intensive operations. Such allocation of functions is exemplary only. In one implementation, the high-speed controller P08 is coupled to memory P04, display P16 (e.g., through a graphics processor or accelerator), and to high-speed expansion ports P10, which may accept various expansion cards (not shown). In the implementation, low-speed controller P12 is coupled to storage device P06 and low-speed expansion port P14. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device P00 may be implemented in a number of different forms, as shown in the figure. For example, it may be implemented as a standard server P20, or multiple times in a group of such servers. It may also be implemented as part of a rack server system P24. In addition, it may be implemented in a personal computer such as a laptop computer P22. Alternatively, components from computing device P00 may be combined with other components in a mobile device (not shown), such as device P50. Each of such devices may contain one or more of computing device P00, P50, and an entire system may be made up of multiple computing devices P00, P50 communicating with each other.

Computing device P50 includes a processor P52, memory P64, an input/output device such as a display P54, a communication interface P66, and a transceiver P68, among other components. The device P50 may also be provided with a storage device, such as a microdrive or other device, to provide additional storage. Each of the components P50, P52, P64, P54, P66, and P68, are interconnected using various buses, and several of the components may be mounted on a common motherboard or in other manners as appropriate.

The processor P52 can execute instructions within the computing device P50, including instructions stored in the memory P64. The processor may be implemented as a chipset of chips that include separate and multiple analog and digital processors. The processor may provide, for example, for coordination of the other components of the device P50, such as control of user interfaces, applications run by device P50, and wireless communication by device P50.

Processor P52 may communicate with a user through control interface P58 and display interface P56 coupled to a display P54. The display P54 may be, for example, a TFT LCD (Thin-Film-Transistor Liquid Crystal Display) or an OLED (Organic Light Emitting Diode) display, or other appropriate display technology. The display interface P56 may comprise appropriate circuitry for driving the display P54 to present graphical and other information to a user. The control interface P58 may receive commands from a user and convert them for submission to the processor P52. In addition, an external interface P62 may be provided in communication with processor P52, so as to enable near area communication of device P50 with other devices. External interface P62 may provide, for example, for wired communication in some implementations, or for wireless communication in other implementations, and multiple interfaces may also be used.

The memory P64 stores information within the computing device P50. The memory P64 can be implemented as one or more of a computer-readable medium or media, a volatile memory unit or units, or a non-volatile memory unit or units. Expansion memory P74 may also be provided and connected to device P50 through expansion interface P72, which may include, for example, a SIMM (Single In Line Memory Module) card interface. Such expansion memory P74 may provide extra storage space for device P50, or may also store applications or other information for device P50. Specifically, expansion memory P74 may include instructions to carry out or supplement the processes described above, and may include secure information also. Thus, for example, expansion memory P74 may be provide as a security module for device P50, and may be programmed with instructions that permit secure use of device P50. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory P64, expansion memory P74, or memory on processor P52 that may be received, for example, over transceiver P68 or external interface P62.

Device P50 may communicate wirelessly through communication interface P66, which may include digital signal processing circuitry where necessary. Communication interface P66 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver P68. In addition, short-range communication may occur, such as using a Bluetooth, Wi-Fi, or other such transceiver (not shown). In addition, GPS (Global Positioning System) receiver module P70 may provide additional navigation- and location-related wireless data to device P50, which may be used as appropriate by applications running on device P50.

Device P50 may also communicate audibly using audio codec P60, which may receive spoken information from a user and convert it to usable digital information. Audio codec P60 may likewise generate audible sound for a user, such as through a speaker, e.g., in a handset of device P50. Such sound may include sound from voice telephone calls, may include recorded sound (e.g., voice messages, music files, etc.) and may also include sound generated by applications operating on device P50.

The computing device P50 may be implemented in a number of different forms, as shown in the figure. For example, it may be implemented as a cellular telephone P80. It may also be implemented as part of a smart phone P82, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

In this specification and the appended claims, the singular forms "a," "an" and "the" do not exclude the plural reference unless the context clearly dictates otherwise. Further, conjunctions such as "and," "or," and "and/or" are inclusive unless the context clearly dictates otherwise. For example, "A and/or B" includes A alone, B alone, and A with B. Further, connecting lines or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A method comprising:

predicting a predicted time of a predicted virtual contact of a virtual reality controller with a virtual musical instrument;

determining, based on at least one parameter of the predicted virtual contact and a predicted latency, a characteristic of a virtual sound to be produced by the virtual musical instrument in response to the virtual contact; and initiating producing the virtual sound in response to the predicted latency of the virtual contact of the virtual reality controller with the virtual musical instrument being determined.

2. The method of claim 1, wherein the parameter for the predicted contact comprises a velocity.

3. The method of claim 1, wherein the predicting the virtual contact comprises using a determined location and a determined velocity to extrapolate to a predicted future location.

4. The method of claim 3, further comprising at least one of using a captured image and/or an object tracking to determine the location and/or the velocity.

5. The method of claim 1, further comprising determining when to initiate producing the virtual sound based on a system computational load.

6. The method of claim 1, further comprising predicting the at least one parameter of the predicted virtual contact, wherein the at least one parameter comprises at least one of a velocity of impact, a location of impact, a failure to impact, a momentum, a force, a direction of impact, an area of impact, or a missed contact.

7. The method of claim 1, further comprising, when the contact does not occur, automatically adjusting a position of the virtual musical instrument so the virtual reality controller contacts the virtual musical instrument at another time.

8. The method of claim 1, further comprising:

determining a characteristic of the contact of the virtual reality controller with the virtual musical instrument; and predicting a second virtual contact of the virtual reality controller with the virtual musical instrument based on the determining the characteristic of the contact of the virtual reality controller with the virtual musical instrument.

9. The method of claim 1, further comprising:

determining a gesture of the virtual reality controller; and adjusting a position parameter associated with the virtual musical instrument in response to the determining the characteristic of the contact of the virtual reality controller on the virtual musical instrument.

10. The method of claim 9, wherein the position parameter comprises at least one of a location, an angle, and/or a height.

11. The method of claim 1, further comprising:

determining a gesture of the virtual reality controller; and removing the virtual musical instrument from a virtual environment in response to the gesture.

12. The method of claim 11, wherein the second virtual contact comprises at least one of a throw, a toss, a flip, a push, a kick, or a swipe.

13. The method of claim 1, further comprising:

determining a gesture of the virtual reality controller; and adding a second virtual musical instrument to a virtual environment in response to the gesture.

14. The method of claim 1, further comprising:

determining a gesture of the virtual reality controller; and repositioning the virtual musical instrument in response to the gesture.

15. The method of claim 14, further comprising applying a position parameter of the repositioned virtual musical instrument to automatically position another virtual object.

16. The method of claim 15, wherein the another virtual object comprises an assistive device.

17. The method of claim 1, further comprising rendering the virtual contact of the virtual reality controller with the virtual musical instrument for display inside of a head mounted display device.

18. An apparatus comprising:

a processor; and a non-transitory machine-readable storage media storing instruments that, when executed, causes the processor to:

predict a predicted time of a predicted virtual contact of a virtual reality controller with a virtual musical instrument;

determine, based on at least one parameter of the predicted virtual contact and a predicted latency, a characteristic of a virtual sound to be produced by the virtual musical instrument in response to the virtual contact; and initiate producing the virtual sound in response to the predicted latency of the virtual contact of the virtual reality controller with the virtual musical instrument being determined.

19. The apparatus of claim 18, wherein the instructions, when executed, cause the processor to additionally render the virtual contact of the virtual reality controller with the virtual musical instrument for display inside of a head mounted display device.

20. A non-transitory machine-readable media storing machine-readable instructions that, when executed, cause a machine to at least:

predict a predicted time of a predicted virtual contact of a virtual reality controller with a virtual musical instrument;

determine, based on at least one parameter of the predicted virtual contact and a predicted latency, a characteristic of a virtual sound to be produced by the virtual musical instrument in response to the virtual contact; and initiate producing of the virtual sound in response to the predicted latency of the virtual contact of the virtual reality controller with the virtual musical instrument being determined.

* * * * *